US005501146A

United States Patent [19]

Yamanaka et al.

[11] Patent Number: 5,501,146

[45] Date of Patent: Mar. 26, 1996

[54] CYLINDRICAL DRUM ASSEMBLY INCLUDING A STENCIL SHEET FOR USE WITH A STENCIL PRINTING MACHINE

[75] Inventors: Tetsu Yamanaka; Kengo Sugaya; Syouichi Ikezima, all of Tokyo, Japan

[73] Assignee: Riso Kagaku Corporation, Tokyo, Japan

[21] Appl. No.: 219,145

[22] Filed: Mar. 29, 1994

[30] Foreign Application Priority Data

Apr. 1, 1993 [JP] Japan ..... 5-075772

[51] Int. Cl.[6] ..... B41N 1/24

[52] U.S. Cl. ..... 101/116; 101/127; 101/128.21; 428/374; 428/395

[58] Field of Search ..... 101/116, 119, 101/120, 127, 128.21; 428/373, 374, 395

[56] References Cited

U.S. PATENT DOCUMENTS

| | | | |
|---|---|---|---|
| 4,469,540 | 9/1984 | Furukawa et al. | 156/62.4 |
| 4,959,260 | 9/1990 | Tomoyasu et al. | 428/373 |
| 5,336,552 | 8/1994 | Strack et al. | 428/373 |
| 5,372,885 | 12/1994 | Tabor et al. | 428/373 |

FOREIGN PATENT DOCUMENTS

| | | | |
|---|---|---|---|
| 439960 | 8/1991 | European Pat. Off. | 101/127 |
| 207289 | 11/1984 | Japan | 101/128.21 |
| 229588 | 10/1986 | Japan | 101/128.21 |
| 47591 | 2/1989 | Japan | 101/127 |
| 305495 | 10/1992 | Japan | 101/128.21 |
| 2241674 | 9/1991 | United Kingdom . | |

OTHER PUBLICATIONS

"Developments in Specialty Screen Fabrics", Screen Printing Nov. 1983, Betsy Dassau, pp. 108–111.

"Working with the new screen fabrics", Screen Printing May 1976, Arnold Z. Brav, pp. 27–29, 49, 51.

*Primary Examiner*—Stephen Funk

*Attorney, Agent, or Firm*—Fay, Sharpe, Beall, Fagan, Minnich & McKee

[57] ABSTRACT

In a cylindrical drum 1 for stencil printing which consists of a porous cylindrical plate 2 and a screen layer 3, in which a stencil sheet is attached to the outer surface of the screen layer having an ink permeability, an ink is supplied from the inner surface of the porous cylindrical body which rotates around its own central axis, the present invention provides a screen layer consisting of a woven fabric of conjugated fibers of a sheath-and-core or a side-by-side type consisting of a lower melting component and a higher melting component and making the intersections of the fibers fixed together through the melt-adhesion of the lower melting point component by means of thermocompression bonding.

10 Claims, 1 Drawing Sheet

FIG. 1A
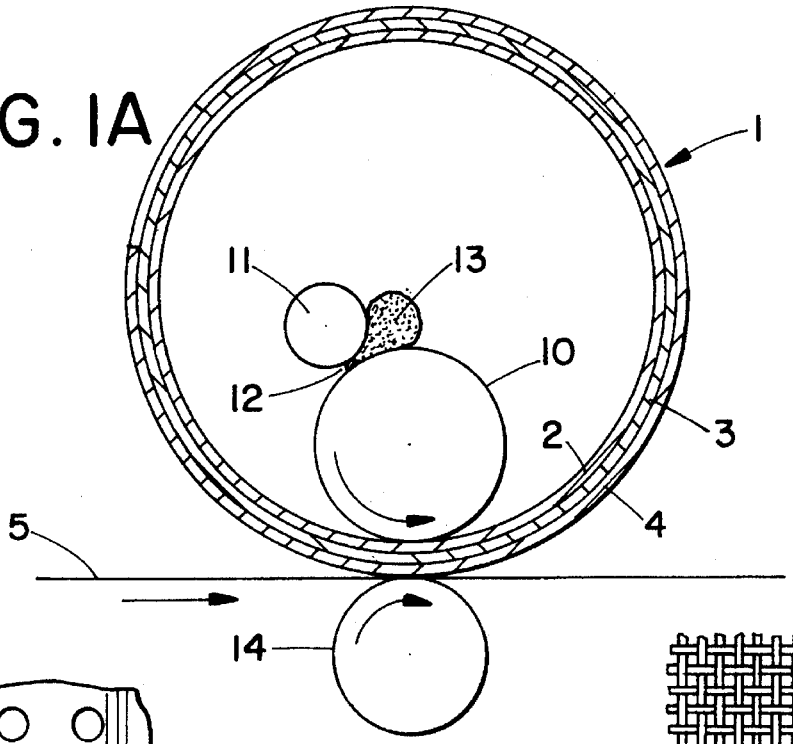
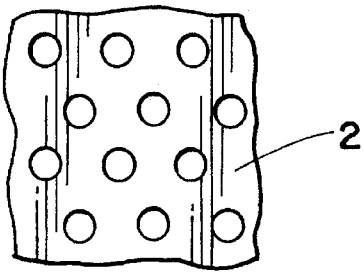
FIG. 2
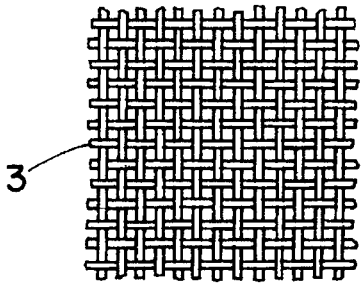
FIG. 3
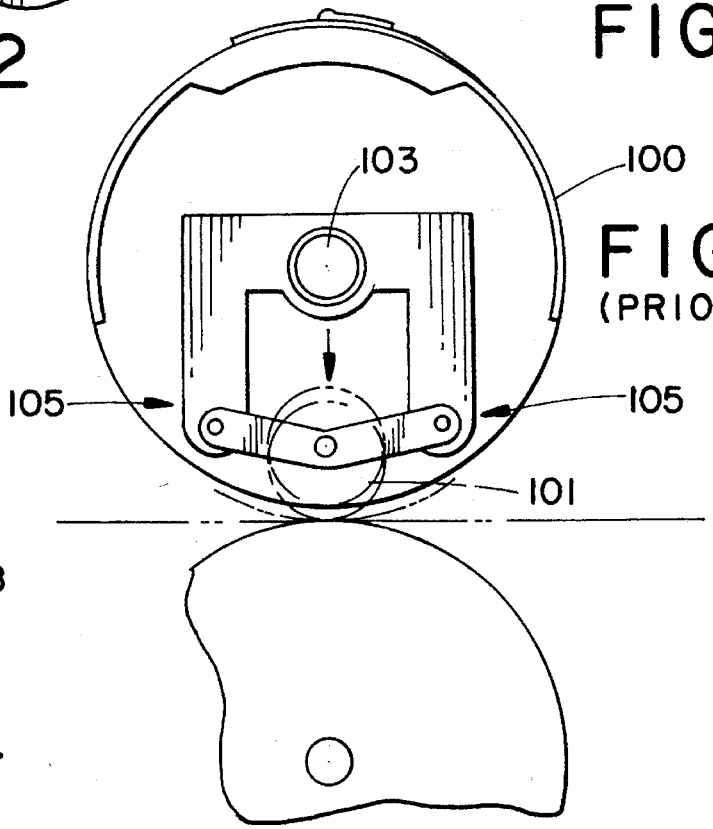
FIG. 1B
(PRIOR ART)
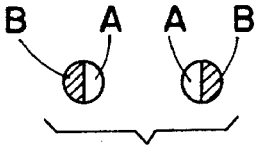
FIG. 4

CYLINDRICAL DRUM ASSEMBLY INCLUDING A STENCIL SHEET FOR USE WITH A STENCIL PRINTING MACHINE

BACKGROUND OF THE INVENTION

1. Field of the Invention

The present invention relates to a cylindrical drum for stencil printing. Specifically, it relates to a cylindrical drum for stencil printing which is suitable to the controlling of ink transferability, etc., in a rotary type stencil printing machine.

2. Description of the Prior Art

A stencil printing method has an advantage in that a large amount of printed matters can thereby be obtained more economically in comparison with the costs if done by other printing methods. A rotary type stencil printing machine has been known as a printing machine which is allowed to exert its advantage at a maximum.

The rotary type stencil printing machine has a porous cylindrical drum which rotates around its own axis. A stencil sheet is attached to the outer surface of the porous cylindrical drum; an ink is supplied from the inner surface of the porous cylindrical drum. Such a cylindrical drum generally has a metallic supporting cylinder having numerous small pores, which may be called a porous cylindrical body and a screen layer rolled around the outer surface of the supporting cylinder described above, which directly rolls the screen layer cylindrically around a pair of flanges which is supported by a center rod without using the metallic supporting cylinder described above, and others.

As a screen layer described above, in order to improve the ink transfer quality, a screen layer consisting of polyester fibers having a fine net structure, and a screen multi-layer composed of a lower mesh stainless screen and a higher mesh polyester fiber screen are known (Japanese Patent Publication No. 63-59393 and Japanese Patent Application laid-open No. 3-254986).

However, when the screen layer of a fine net structure is provided to the supporting cylinder, the stitch deviation of the screen occurs easily. As a result, there is a disadvantage in that the small pores in the supporting cylinder appear as a shadow on the printed image. Further, in the case of a screen multi-layer, it was often inconvenient that an ink was retained between the two layers.

Also, in the case of having no supporting cylinder, since an ink supply roller built in the cylindrical drum is brought in direct contact with the screen, there are such problems that the printing ink cannot uniformly be supplied because the stitch deviation of the screen is large, the deflection thereof is easily yielded at the time of the printing operation because the rigidity thereof is short, and that the pressure distribution at the time of printing becomes nonuniform because the surface condition of the screen is not smooth.

SUMMARY OF THE INVENTION

It is accordingly a main object of the present invention to solve the disadvantages in the prior art and provide such a cylindrical drum for stencil printing that allows running the operation at a low cost and improves the ink transferability and the printing quality.

The screen to be used for the screen layer in the present invention can be obtained by weaving a sheath-and-core type or a side-by-side type conjugated fiber consisting of both a lower melting point component and a higher melting point component by a conventional method, then subjecting it to thermocompression so as to adhere the intersections of the fibers with each other through the lower melting point components of the fibers thereby. The temperature difference between the melting points of the lower melting point and higher melting point components is preferably 20° C. or more.

As a lower melting point component of the conjugated fibers, there is no particular limitation of the component so long as the component can bond the intersections of the fibers to each other by being melted or softened through thermocompression. The following thermoplastic resins may be exemplified, such as polyethylene terephthalate (polyester) copolymer, polypropylene, polypropylene-ethylene copolymer, etc.

Polyester copolymer can be obtained by copolymerizing the other monomers or reactive components than those used as raw materials at the time of polycondensation of ethylene glycol and phthalic acid. Such monomers or reactive components may be polyalkyleneglycol, dicarboxylic acid, lower molecular weight glycol, etc.

As a higher melting point component, there is no particular limitation of the component so long as the component has a good adhesivity to the lower melting point components and does not melt or deform at the time of thermocompression, but it is preferable to use a resin component having a low affinity with the ink in order to improve the permeability of the ink. As such resins, polyethylene terephthalate, polypropylene etc. are exemplified. Polyethylene terephthalate may be preferably used in the viewpoint of a melting point and strength.

In the case when the higher melting point component is polyethylene terephthalate, polyester copolymer is preferred as a lower component.

In the case of the conjugated fibers of a sheath and core type, the lower melting point component is used as a sheath component thereof.

The content ratio of the lower melting point component in the conjugated fibers may be such an amount as the component may be melted for allowing to adhere and fix the intersections of the fibers and the pores in the screen may not be damaged, and it is assumed to be in the range of 5–70% and preferably in the range of 10–50%. The sectional shape of the conjugated fibers may be a round or deformed sectional one.

The conjugated fibers of a sheath-and-core type or a side-by-side type can be obtained by a conventional melt-spinning process using known conjugate spinning nozzles and the resulting conjugated fibers (filaments) are woven to a fabric, a plain weave fabric, for example, by a conventional method to obtain the screen layer in the present invention. The screen may be composed only by the conjugated fibers. However, a portion of the fibers may be replaced by regular fibers. For example, the conjugated fibers may be used only for warps or wefts or every other or third of a warp or weft, etc. As a fiber to be used other than the conjugated fibers, for example, regular fibers consisting of polyester having its higher melting point component described above can be used.

According to the thermocompression processing, the lower melting point component of the conjugated fibers is melted and the intersections of the fibers are bonded to be fixed to each other. The temperatures and pressures for thermocompression bonding are appropriately determined depending on the materials of the screen. For example, in the case of the fabric consisting of polyester conjugated fibers which use copolymer polyester as a lower melting point component and homopolyester as a higher melting component, it can be thermocompressed by making it pass between a metal roller heated at 120° C. and a silicone rubber roller under the nip pressure of 1.8 kg/cm$^2$. A temperature of a heating roller is not necessary to reach the melting point of the lower melting point component as far as the intersection of the fibers are bonded by the lower melting point component. Whether they are bonded or not can be easily observed by microscope, for example.

There is no particular limitation of the sieve opening in the screen after the thermal compression bonding, but in the viewpoint of the ink transferability, the range of 70–400 mesh is preferable, and its thickness in the range of 40–200 μm is preferable. As a screen layer, the single layer is usually preferable, but the double layers may be possible.

By using the screen layer bonded at the intersections of the fibers, the occurrence of stitch deviation and deflection of the screen can be prevented, the thickness of the screen can be uniformly thinned, and the smoothness in the screen surface can be improved. As a result, whether a supporting cylinder may be available or not, the control of ink transferability becomes easy and the printed image quality as well as the printing workability is improved.

The present invention is described in more detail in view of the drawings.

BRIEF DESCRIPTION OF THE DRAWINGS

FIG. 1A is a schematic view showing a rotary type stencil printing machine equipped with a cylindrical drum having porous cylindrical body in the present invention.

FIG. 1B is a schematic view showing a prior art cylindrical drum such as in FIG. 1A, including a pair of flanges and a center rod.

FIG. 2 is an enlarged plan view of a porous cylindrical body constituting the cylindrical drum in FIG. 1A.

FIG. 3 is a plan view of a screen layer used in the present invention.

FIG. 4 is an illustration of side-by-side conjugated fibers.

DESCRIPTION OF THE PREFERRED EMBODIMENTS

In FIG. 1A, a cylindrical drum 1 consists of a porous cylindrical body 2 having numerous small pores constituting the innermost layer, and a screen layer 3 rolled around the cylindrical body 2. In the cylindrical body, there is provided a squeeze roller 10 rotationally driving in the same direction with the cylindrical body 2 while contacting with the inner surface of the cylindrical body 2, and a fixed doctor rod 11 facing to the outer surface of squeeze roller 10 while keeping a predetermined small space 12 between the squeeze roller 10 and the doctor rod 11, and working together with the squeeze roller 10. The cylindrical body 2 and the squeeze roller 10 have a driving means (not shown) for rotating around their center axis. The cylindrical body 2 has numerous ink permeable small pores as illustrated in FIG. 2. The small pores of the supporting cylinder 2 are normally in the range of 20–60 mesh. The screen layer 3 consisting of a plain weave fabric is shown in FIG. 3. A press roller 14 for pressing a printing paper to the outer surface of the cylindrical drum 1 is positioned under the cylindrical drum 1 and provided with a mechanism for moving upwardly or downwardly for pressing or releasing a printing paper 5.

In the stencil printing, a stencil sheet 4 is attached to the outer surface of the screen layer 3. A printing paper 5 for stencil printing is fed between the cylindrical drum 1 and the press roller 14 and is pressed to the stencil sheet 4 attached to the outer surface of the cylindrical drum 1 by a platen roller 14 and transferred. An ink is supplied to an ink reservoir portion 13 formed between the squeeze roller 10 and the doctor rod 11. The ink in the ink reservoir portion 13 is passed through the squeeze roller 10, porous cylindrical body 2, screen layer 3 and the stencil sheet 4, and transcribed on a printing paper. The feeding amount of ink can be controlled by changing the clearance between the squeeze roller 10 and the doctor rod 11.

An alternative cylindrical drum arrangement is depicted in FIG. 1B. Cylindrical drum 100 is rotatably supported on a stationary center axis or rod 103. An inside pusher roller 100 is vertically movably attached to a pair of arms or flanges 105, 105 and is engageable with the inner circumferential surface of the cylindrical drum 100.

The details of the present invention will be explained according to the following Examples. It should be understood, however, that the scopes and effects of the present invention are not limited by the following examples.

EXAMPLE 1

A screen (a plain weave fabric made by NBC Industry Co., sieve opening 200 mesh and thickness 75 μm) consisting of polyester conjugated fibers (monofilaments) having a sheath and core structure (sheath component: copolymerized polyester of m.p. ca. 200° C.; core component: homopolyester of m.p. ca. 265° C.; conjugate ratio (weight) 1:1) was passed through between a metal roller heated at 120° C. and a silicone rubber roller at a nip pressure of 1.8 kg/cm$^2$. The resulting screen was installed to the drum (a porous cylindrical body) of a stencil printing machine (Riso Kagaku Corporation product, RC-115) to carry out stencil printing in the same apparatus. As a result, a good image was obtained, and there were no problems such as the stitch deviation and deflection of the screen during the printing operation.

EXAMPLE 2

A screen (sieve opening 200 mesh and thickness 75 μm) was prepared by subjecting the side-by-side type polyester conjugated fibers as a weft, which fibers were obtained by conjugate-spinning a lower melting component (copolymerized polyester) and a higher melting component (homopolyester) at the ratio of 50/50 (by weight), and the regular polyester fibers as a warp, to a conventional plain weaving process. The resulting screen was thermo-compressed under the similar condition to that of Example 1, and then, applied to stencil printing in the same manner as in Example 1. As a result, a good image was obtained and there were no problems such as the stitch deviation and deflection of the screen during the printing operation.

FIG. 4 illustrates two side-by-side conjugate fibers each having a lower melting point component A and a higher melting point component B.

Comparative Example 1

A screen (NBC Co. product, PP200, sieve opening 200 mesh and thickness 160 μm) consisting of polypropylene fibers was thermocompressed under the similar condition to that of Example 1, and then, similarly installed to the drum. Stencil printing was thereby carried out. As a result, although the rigidity of the screen was improved, as some of the fibers were deformed or melted by heat, the opening ratio of the screen was lowered, the image concentration of the printed matters was extremely thin, and no good images could be obtained.

Comparative Example 2

Example 1 was repeated except that the screen was not thermocompressed. As a result, the stitch deviation and deflection of the screen was occurred and nonuniform portions were generated in the printed images.

According to the present invention, by using the screen layer bonded at the intersections of the conjugated fibers by the thermocompression, it is possible to improve the rigidity and toughness of the screen, prevent the generation of the stitch deviation and deflection of the screen at the time of printing operation, uniformly thin the thickness of the screen, improve the smoothness of the screen surface, easily control the ink transferability, and develop the image quality of the printed matters as well as the printing workability. Furthermore, everything may be set up by mounting only a single sheet of the screen layer on the cylindrical body or on the flanges, resulting in lowering the cost for assembling the stencil printing apparatus.

What is claimed:

1. A cylindrical drum for stencil printing comprising:

a porous cylindrical body having a means for feeding an ink onto an inner surface thereof; and a screen layer having an ink permeability provided on an outer surface of said porous cylindrical body;

said screen layer comprised of a fabric using side-by-side conjugated fibers consisting of a lower melting point component as one side component and a higher melting point component as an other side component, intersections of said fibers adhered with each other, at least one of the fibers which form the intersections having a softened lower melting point component.

2. A cylindrical drum according to claim 1, wherein said means for feeding the ink is a squeeze roller provided in said cylindrical body so that the squeeze roller rotates in contact with the inner surface of said cylindrical body.

3. A cylindrical drum according to claim 1, wherein a difference in the melting points of said lower melting point component and said higher melting point component is 20° C. or more.

4. A cylindrical drum according to claim 1, wherein said higher melting point component of the conjugated fiber is homopolyester, and said lower melting point component of the conjugated fiber is copolymerized polyester.

5. A cylindrical drum according to claim 1, wherein the conjugated fibers which form said intersections are thermocompressed conjugated fibers.

6. A cylindrical drum for stencil printing comprising:

a pair of flanges supported by a center rod provided between the flanges;

a screen layer having an ink permeability, rolled around the pair of flanges to form a cylindrical body; and a means for feeding an ink onto an inner surface of the screen layer;

said screen layer including a fabric using side-by-side conjugated fibers consisting of a lower melting point component as one side component and a higher melting point component as an other side component, intersections of said fibers adhered with each other, at least one of the fibers which form the intersections having a softened lower melting point component.

7. A cylindrical drum according to claim 6, wherein said means for feeding the ink is a squeeze roller provided in said cylindrical body so that the squeeze roller rotates in contact with the inner surface of said cylindrical body.

8. A cylindrical drum according to claim 6, wherein a difference in the melting points of said lower melting point component and said higher melting point component is 20° C. or more.

9. A cylindrical drum according to claim 6, wherein said higher melting point component of the conjugated fiber is homopolyester, and said lower melting point component of the conjugated fiber is copolymerized polyester.

10. A cylindrical drum according to claim 6, wherein the conjugated fibers which form said intersections are thermocompressed conjugated fibers.

* * * * *